US011643178B2

(12) United States Patent
Kimpara

(10) Patent No.: US 11,643,178 B2
(45) Date of Patent: May 9, 2023

(54) PROPELLER APPARATUS

(71) Applicant: SUZUKI MOTOR CORPORATION, Hamamatsu (JP)

(72) Inventor: Masatoshi Kimpara, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 17/703,682

(22) Filed: Mar. 24, 2022

(65) Prior Publication Data

US 2022/0402588 A1 Dec. 22, 2022

(30) Foreign Application Priority Data

Jun. 16, 2021 (JP) ..... JP2021-100413

(51) Int. Cl.
*B63H 1/20* (2006.01)

(52) U.S. Cl.
CPC ..... *B63H 1/20* (2013.01)

(58) Field of Classification Search
CPC ..... B63H 2023/342; B63H 2023/346; B63H 1/20; B63H 1/15
See application file for complete search history.

(56) References Cited

U.S. PATENT DOCUMENTS 4,826,404 A * 5/1989 Zwicky ..... B63H 23/34 416/169 R
5,908,284 A * 6/1999 Lin ..... F16D 9/06 416/169 R
2014/0205455 A1 7/2014 Kuroki ..... 416/134 R
2017/0066516 A1 3/2017 Kuroki ..... B63H 1/15

FOREIGN PATENT DOCUMENTS

JP 2014-141120 A 8/2014

* cited by examiner

*Primary Examiner* — Eldon T Brockman
(74) *Attorney, Agent, or Firm* — Stein IP, LLC

(57) ABSTRACT

A propeller apparatus of a ship propulsion machine includes a tubular member inserted into an insertion hole so as to be movable in a circumferential direction with respect to a hub. First concave portions arranged in a circumferential direction are formed in an outer peripheral surface of the tubular member. Second concave portions arranged in the circumferential direction so as to respectively face the first concave portions are formed in an inner peripheral surface of the insertion hole. Each of the elastic bodies has a spherical or columnar shape, a first portion of each of the elastic bodies is disposed in each of the first concave portions, a second portion of each of the elastic bodies is disposed in each of the second concave portions, and the elastic bodies are rotatably held between the first concave portions and the second concave portions facing each other.

5 Claims, 9 Drawing Sheets

PROPELLER APPARATUS

CROSS-REFERENCE TO RELATED APPLICATIONS

The disclosure of Japanese Patent Application No. 2021-100413 filed on Jun. 16, 2021, including specification, drawings and claims is incorporated herein by reference in its entirety.

BACKGROUND

The present invention relates to a propeller apparatus of a ship propulsion machine.

In general, a propeller apparatus is provided at a rear end portion of a propeller shaft of a ship propulsion machine. The propeller apparatus includes a propeller provided with a plurality of blades on an outer peripheral side of a hub, and a tubular bushing. The bushing is inserted into a hole provided in a center of the hub, and is non-rotatably fixed to the hub. Further, the rear end portion of the propeller shaft is inserted into an inner side of the bushing. The bushing is spline-coupled to the rear end portion of the propeller shaft, and is non-rotatably fixed to the propeller shaft. The propeller is connected to the rear end portion of the propeller shaft via the bushing in this way, and rotation of the propeller shaft is transmitted to the propeller via the bushing.

Some propeller apparatuses in the related art include a damper that absorbs an impact between the propeller shaft and the propeller. Patent Literature 1 below describes a propeller apparatus in the related art including such a damper. In the propeller apparatus, a bushing is fitted into a hub so as to be movable in a circumferential direction with respect to the hub. Further, three ribs that protrude inward in a radial direction of the hub and extend in an axial direction of the hub are provided on an inner peripheral surface of the hub at intervals in a circumferential direction of the hub. Further, three ribs that protrude outward in a radial direction of the bushing and extend in an axial direction of the bushing are provided on an outer peripheral surface of the bushing at intervals in a circumferential direction of the bushing. Further, a damper formed of an elastic material such as natural rubber is disposed in a space surrounded by the inner peripheral surface of the hub, the outer peripheral surface of the bushing, the ribs provided on the inner peripheral surface of the hub, and the ribs provided on the outer peripheral surface of the bushing. When a propeller shaft is rotated and the bushing is rotated accordingly, the damper is pressed and deformed in a circumferential direction by the ribs provided on the inner peripheral surface of the hub and the ribs provided on the outer peripheral surface of the bushing. Accordingly, the impact between the propeller shaft and the propeller is reduced by the damper.

Patent Literature 1: JP-A-2014-141120

SUMMARY

According to one advantageous aspect of the invention, there is provided a propeller apparatus of a ship propulsion machine, the propeller apparatus including:

a propeller including a hub having an insertion hole formed in a center thereof and a plurality of blades provided on the hub;

a tubular member inserted into the insertion hole and configured such that a propeller shaft is inserted into an inner side of the tubular member and the tubular member is non-rotatably coupled to the propeller shaft; and a plurality of elastic bodies provided between the tubular member and the hub, and configured to absorb an impact between the propeller shaft and the propeller, and to transmit a rotation of the propeller shaft to the propeller, wherein the tubular member is inserted into the insertion hole in a state of having a backlash so as to be movable in a circumferential direction with respect to the hub, a first concave portion group including a plurality of first concave portions which are arranged in a circumferential direction is formed in an outer peripheral surface of the tubular member, a second concave portion group including a plurality of second concave portions which are arranged in the circumferential direction so as to respectively face the plurality of first concave portions is formed in an inner peripheral surface of the insertion hole, and each of the elastic bodies has a spherical shape or a columnar shape, a first portion of each of the elastic bodies is disposed in each of the first concave portions, a second portion of each of the elastic bodies is disposed in each of the second concave portions, and the elastic bodies are rotatably held between the first concave portions and the second concave portions facing each other.

DETAILED DESCRIPTION OF EXEMPLIFIED EMBODIMENTS

Figure 1:
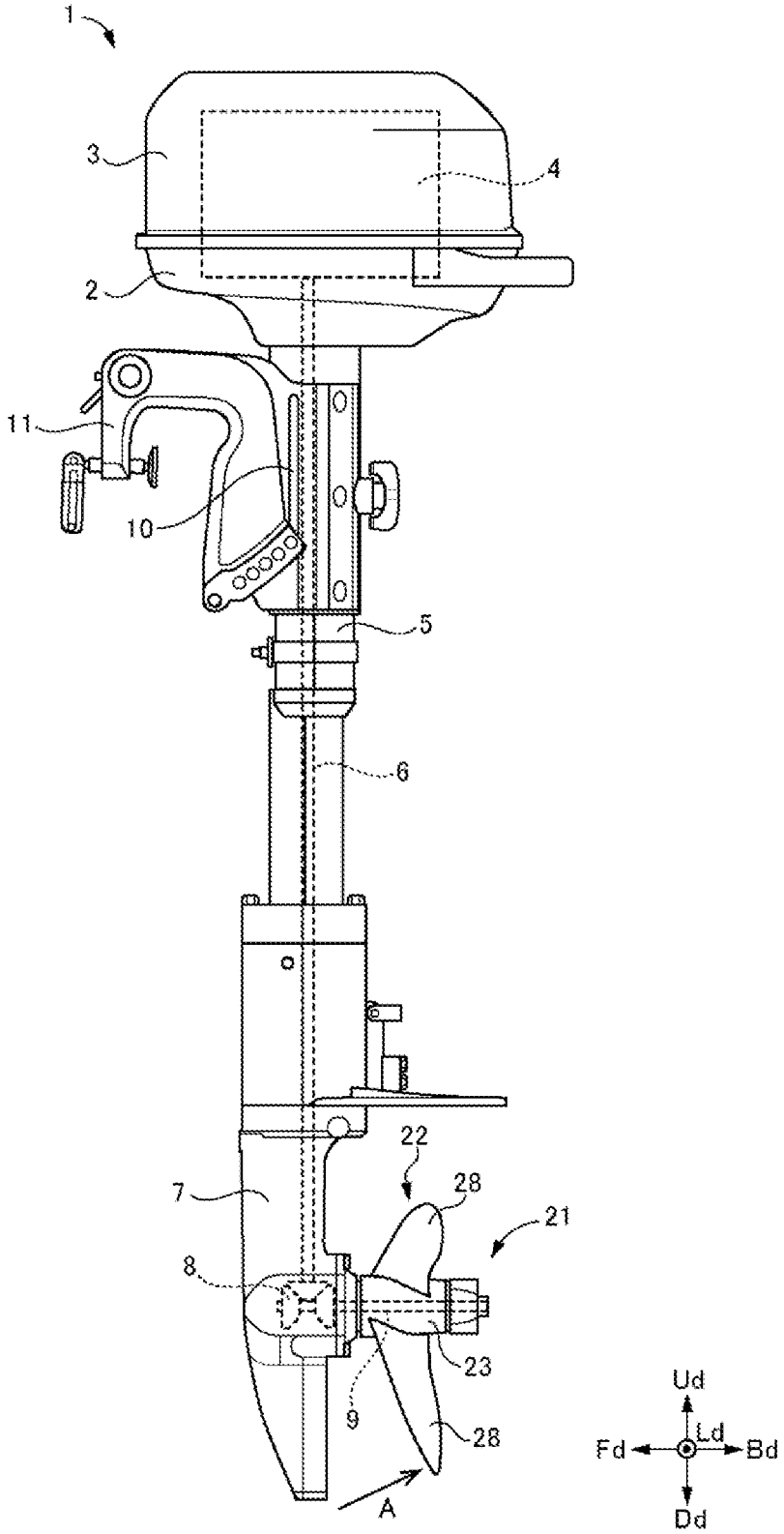
FIG. 1 is an illustrative diagram showing an outboard motor provided with a propeller apparatus of a first embodiment of the present invention.

In the propeller apparatus described in Patent Literature 1 described above, the damper has a belt shape in an overall view having a non-coupling portion, as shown in FIG. 12 of Patent Literature 1. Further, as shown in FIGS. 13 and 17 of Patent Literature 1, the damper is disposed between the bushing and the hub in a state where the non-coupling portion is fitted to the ribs provided on the outer peripheral surface of the bushing. Due to such a configuration, a direction of the damper cannot be changed between the bushing and the hub.

When the direction of the damper cannot be changed between the bushing and the hub, stress concentration on the same place of the damper may be repeated, and the damper may deteriorate or be damaged at an early stage. That is, in a case where the direction of the damper cannot be changed between the bushing and the hub, when the damper is pressed by the ribs of the bushing and the ribs of the hub, places where a degree of deformation is large are always substantially the same in the damper. As a result, the stress concentration on the same place of the damper may be repeated, and the place may deteriorate or be damaged at an early stage during use of the ship propulsion machine.

The damper described in Patent Literature 1 described above has a complicated shape in which a plurality of columnar elastic members are coupled as described in paragraph 0058 of Patent Literature 1, and a large number of irregularities are formed on a surface of the damper as shown in FIG. 12 of Patent Literature 1.

When the shape of the damper is complicated or the large number of irregularities are formed on the surface of the damper, salt, sand, dust, and the like tend to accumulate in a concave portion of the damper, between the damper and the hub, or between the damper and the bushing. When the salt, the sand, the dust, and the like are accumulated in this way, deformation of the damper may be hindered by the accumulated salt, sand, dust, and the like, and an impact absorbing function of the damper may deteriorate.

When the damper has the complicated shape as in the propeller apparatus described in Patent Literature 1 described above, a cost of manufacturing the damper may be increased, and a price of the damper may be high. As a result, when a deteriorated or damaged damper is replaced with a new damper, or when a propeller apparatus having a deteriorated impact absorbing function of the damper is replaced with a new propeller apparatus, an economic burden on a user may be increased.

The present invention has been made in view of, for example, the above-described problems, and an object of the present invention is to provide a propeller apparatus that can prevent early deterioration, damage, or functional deterioration of a component having an impact absorbing function such as a damper, and that can reduce an economic burden of maintenance.

A propeller apparatus of an embodiment of the present invention is a propeller apparatus of a ship propulsion machine, and includes a propeller, a tubular member, and a plurality of elastic bodies. The propeller includes a hub having an insertion hole formed in a center thereof, and a plurality of blades provided on the hub. The tubular member is inserted into the insertion hole of the hub. Further, a propeller shaft is inserted into an inner side of the tubular member, and the tubular member is non-rotatably coupled to the propeller shaft. A plurality of elastic bodies are provided between the tubular member and the hub. The elastic bodies have a function of absorbing an impact between the propeller shaft and the propeller and transmitting rotation of the propeller shaft to the propeller.

The tubular member is inserted into the insertion hole of the hub in a state of having backlash so as to be movable in a circumferential direction with respect to the hub. Further, a plurality of first concave portions are formed in an outer peripheral surface of the tubular member so as to be arranged in the circumferential direction. Further, a plurality of second concave portions are formed in an inner peripheral surface of the insertion hole of the hub so as to face the plurality of first concave portions and be arranged in a circumferential direction. Further, each elastic body is formed in a spherical shape or a columnar shape. Further, in each elastic body, a first portion of the elastic body is positioned in the first concave portion, a second portion of the elastic body is positioned in the second concave portion, and the elastic body is rotatably held between the first concave portion and the second concave portion facing each other.

In the propeller apparatus of the present embodiment having such a configuration, since each elastic body is formed in a spherical shape or a columnar shape and is rotatably held between the first concave portion and the second concave portion, a direction of each elastic body can be changed when a water flow around the propeller apparatus 21 is received or a torque between the tubular member 31 and the hub 23 is suddenly changed. When the direction of each elastic body is changed, a place where a stress occurs in each elastic body is changed. Therefore, according to the propeller apparatus of the present embodiment, it is possible to prevent each elastic body from deterioration or damage at an early stage due to repeated stress concentration on the same place of each elastic body.

Since each elastic body has a spherical shape or a columnar shape, the shape is simple. Therefore, salt, sand, dust, and the like are unlikely to adhere to each elastic body. Further, each elastic body can rotate between the first concave portion and the second concave portion facing each other. Accordingly, water around the propeller apparatus easily and smoothly flows around each elastic body. Therefore, the salt, the sand, the dust, and the like around each elastic body can be discharged to an outside of the propeller apparatus by a water flow, and accumulation of the salt, the sand, the dust, and the like around each elastic body, for example, in the first concave portion, the second concave portion, or the like can be prevented. Therefore, according to the propeller apparatus of the present embodiment, it is possible to prevent that elastic deformation of each elastic body is hindered and an impact absorbing function of each elastic body deteriorates due to the salt, the sand, the dust, and the like adhering to each elastic body, or the salt, the sand, the dust, and the like accumulating around each elastic body.

Since each elastic body has a simple shape, the elastic body is easy to manufacture and is inexpensive. Therefore, an economic burden when replacing the elastic body is small. Therefore, according to the propeller apparatus of the present embodiment, it is possible to reduce the economic burden of maintenance.

First Embodiment

Hereinafter, some embodiments of the present invention will be described. In each embodiment, directions of front (Fd), back (Bd), up (Ud), down (Dd), left (Ld), and right (Rd) follow lower right arrows in FIGS. 1, 2, 5, and the like.

(Outboard Motor)

FIG. 1 shows an outboard motor 1 serving as a ship propulsion machine provided with a propeller apparatus 21 according to a first embodiment of the present invention. In the outboard motor 1 shown in FIG. 1, a bottom cowling 2 and a top cowling 3 are provided on an upper portion, and a power source 4 is provided inside the bottom cowling 2 and the top cowling 3. As the power source 4, an engine (internal combustion engine) or an electric motor is used. Further, an upper casing 5 is provided below the bottom cowling 2, and a drive shaft 6 that extends downward from the power source 4 is provided in the upper casing 5. Further, a lower casing 7 is provided on a lower portion of the outboard motor 1, and a gear mechanism 8 including a plurality of bevel gears and the like and a propeller shaft 9 that extends in a direction orthogonal to the drive shaft 6 are provided in the lower casing 7. Further, the propeller apparatus 21 is provided on a rear end portion of the propeller shaft 9. Further, the outboard motor 1 is also provided with a clamp bracket 11 for attaching the outboard motor 1 to a ship, and a swivel bracket 10 that enables tilting up and down of the outboard motor 1.

When the power source 4 operates, power of the power source 4 is transmitted to the propeller shaft 9 via the drive shaft 6 and the gear mechanism 8, and the propeller apparatus 21 is rotated together with the propeller shaft 9. Further, when the ship to which the outboard motor 1 is attached is moved forward, the propeller shaft 9 and the propeller apparatus 21 are rotated, for example, in a counterclockwise direction in a front view of the outboard motor 1. Further, when the ship is moved backward, the propeller shaft 9 and the propeller apparatus 21 are rotated, for example, in a clockwise direction in the front view of the outboard motor 1. Rotational directions of the propeller shaft 9 and the propeller apparatus 21 can be switched by switching a clutch provided in the gear mechanism 8 when the power source 4 is the engine, and can be switched by switching a rotational direction of the electric motor when the power source 4 is the electric motor.

(Configuration of Propeller Apparatus)

Figure 2:
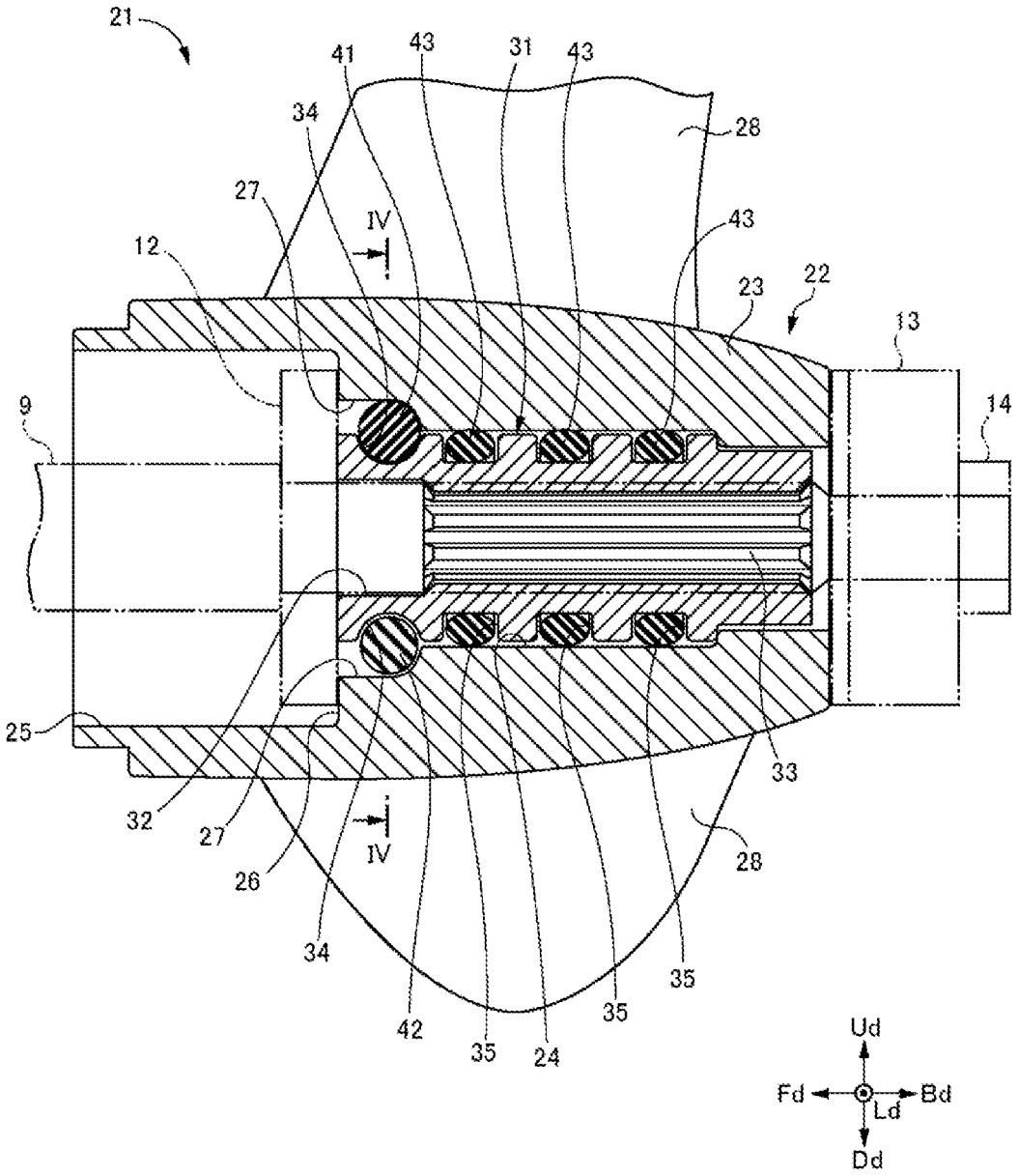
FIG. 2 is a cross-sectional view showing the propeller apparatus of the first embodiment of the present invention.
Figure 3:
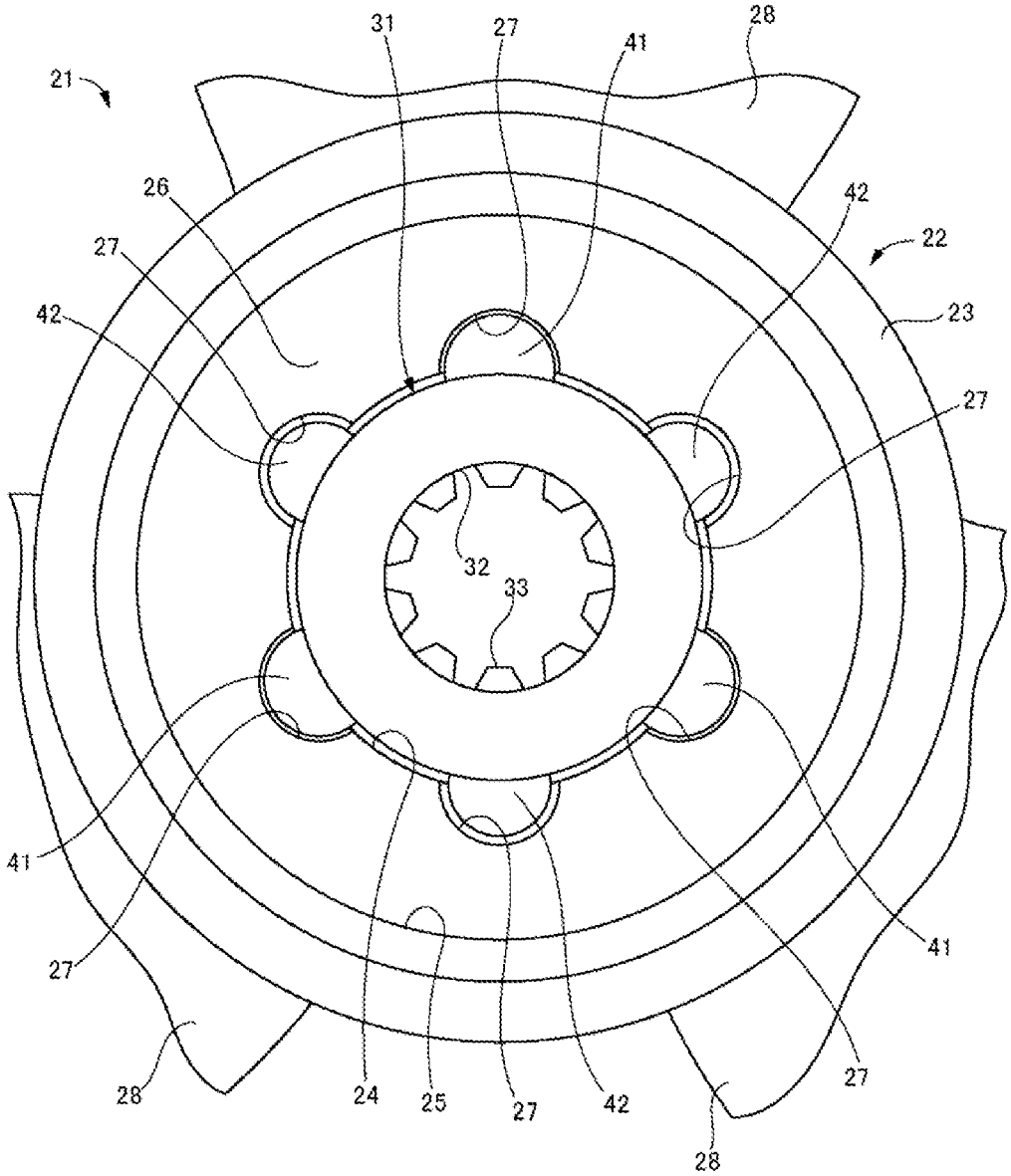
FIG. 3 is an external view showing a state where the propeller apparatus of the first embodiment of the present invention is viewed from a front side.
Figure 4:
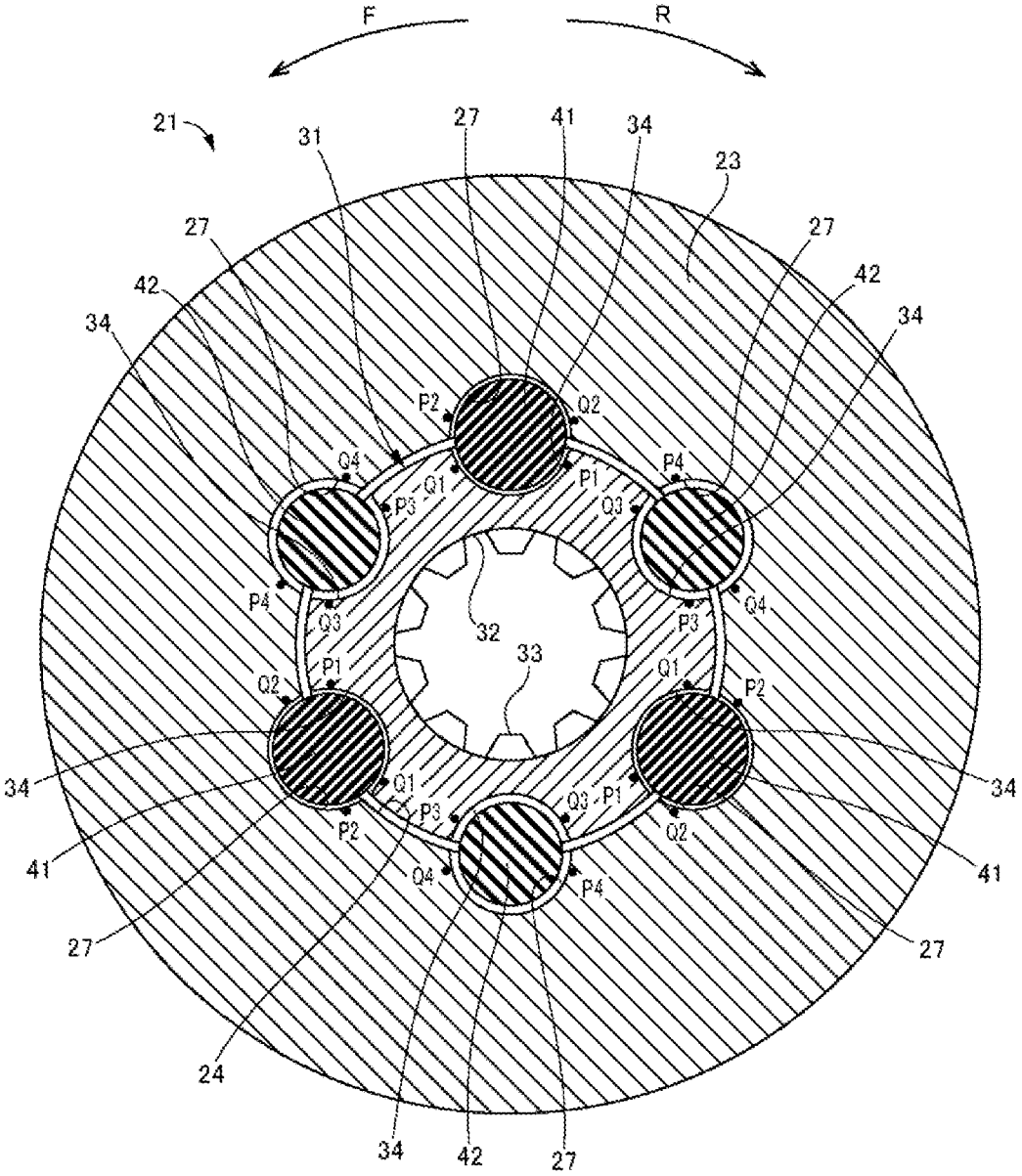
FIG. 4 is a cross-sectional view showing a state where a cross section of the propeller apparatus cut along a cutting line IV-IV in FIG. 2 is viewed from a front side.
Figure 5A:
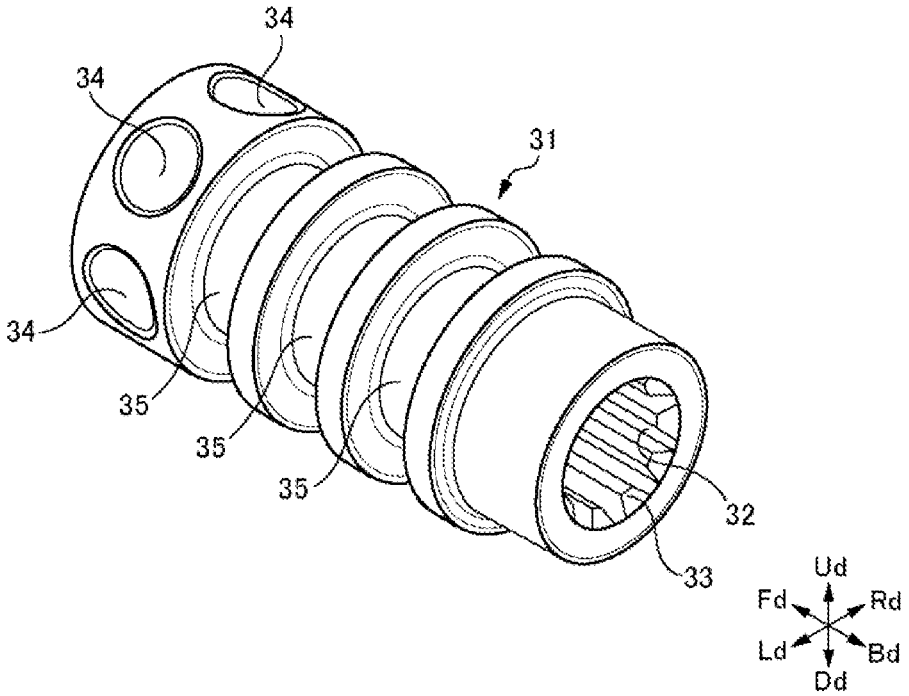
FIGS. 5A and 5B are external views showing a state where a tubular member and the like of the propeller apparatus of the first embodiment of the present invention are viewed from an upper left rear side.
Figure 5B:
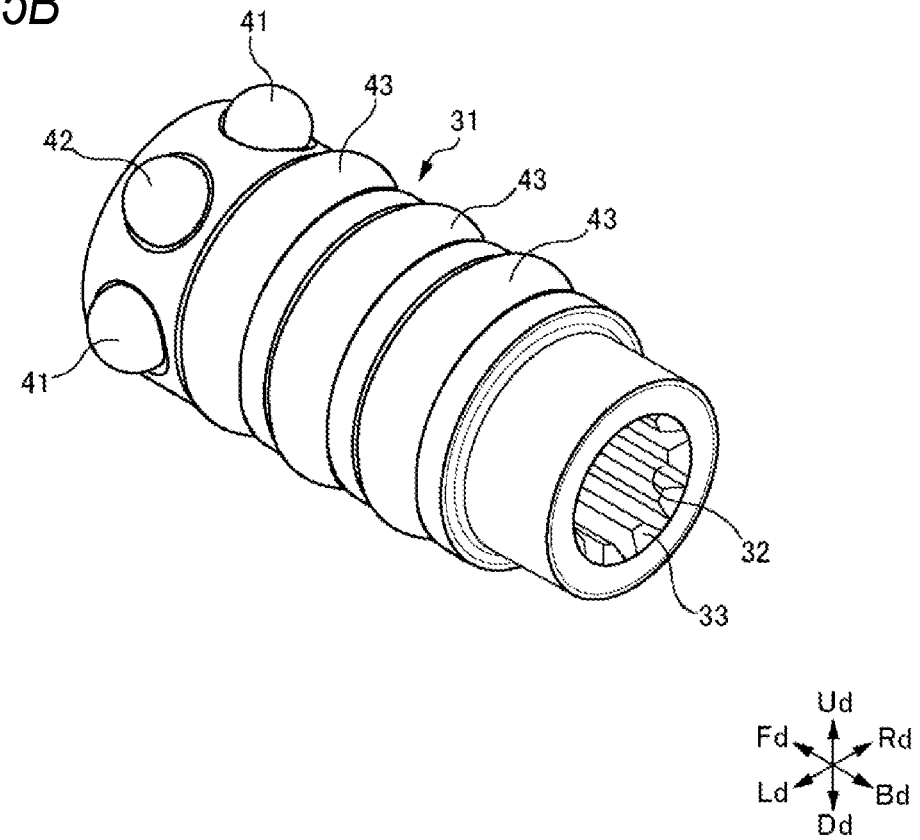

FIG. 2 shows the propeller apparatus 21 according to the first embodiment of the present invention, and specifically shows a state where a cross section of the propeller apparatus 21 cut along a plane that extends in front-rear and upper-lower directions including an axis of the propeller shaft 9 is viewed from a left side. FIG. 3 shows a state where the propeller apparatus 21 is viewed from a front side. FIG. 4 shows a state where a cross section of the propeller apparatus 21 cut along a cutting line IV-IV in FIG. 2 is viewed from a front side. In FIG. 4, illustration of blades 28 is omitted. FIGS. 5A and 5B show a state where a tubular member 31 in the first embodiment of the present invention is viewed from an upper left rear side, and more specifically, FIG. 5A shows the tubular member 31 in a state where spherical elastic bodies 41 and 42 and annular elastic bodies 43 are not provided, and FIG. 5B shows the tubular member 31 in a state where the spherical elastic bodies 41 and 42 and the annular elastic bodies 43 are provided.

As shown in FIG. 2, the propeller apparatus 21 includes a propeller 22, the tubular member 31, a plurality of spherical elastic bodies 41 and 42, and a plurality of annular elastic bodies 43.

The propeller 22 includes a hub 23 and a plurality of blades 28. The hub 23 is formed in a cylindrical shape. Further, an insertion hole 24 and a large-diameter hole 25 are formed in a center of the hub 23. The insertion hole 24 is a hole into which the rear end portion of the propeller shaft 9 and the tubular member 31 are inserted, and is formed in a portion of the hub from a substantially central portion to a rear end in an axial direction. The large-diameter hole 25 is a hole into which a portion of the propeller shaft 9 on a front side of the rear end portion, a front side spacer 12, and the like are inserted, and is formed in a front end side portion of the hub. The large-diameter hole 25 is disposed coaxially with the insertion hole 24 and communicates with the insertion hole 24. Further, a diameter of the large-diameter hole 25 is larger than a diameter of the insertion hole 24, and an annular step portion 26 is formed between the large-diameter hole 25 and the insertion hole 24. Further, the blades 28 are provided on an outer peripheral side of the hub 23.

The tubular member 31 is formed in a cylindrical shape and formed of, for example, a metal material such as stainless steel or brass. The tubular member 31 is inserted into the insertion hole 24 of the hub 23 in a state of having backlash so as to be movable in a circumferential direction with respect to the hub 23. That is, an outer diameter of each part of the tubular member 31 is set to a value smaller than a diameter of each part of the insertion hole 24 facing each part of the tubular member 31 such that the tubular member 31 can move in the circumferential direction with respect to the hub 23 in the insertion hole 24 of the hub 23.

A shaft insertion hole 32 into which the rear end portion of the propeller shaft 9 is inserted is formed on an inner peripheral side of the tubular member 31. A spline 33 is formed on an inner peripheral surface of the shaft insertion hole 32, and a spline is also formed on an outer peripheral surface of the rear end portion of the propeller shaft 9. The tubular member 31 is non-rotatably coupled to the rear end portion of the propeller shaft 9 by fitting the spline 33 of the shaft insertion hole 32 and the spline of the propeller shaft 9. Further, the propeller 22 and the tubular member 31 are attached to the rear end portion of the propeller shaft 9 by using the front side spacer 12, a rear side spacer 13, and a nut 14.

The plurality of spherical elastic bodies 41 and 42 have a function of absorbing an impact between the propeller shaft 9 and the propeller 22 and transmitting rotation of the propeller shaft 9 to the propeller 22. Each of the spherical elastic bodies 41 and 42 is formed in a spherical shape. The spherical elastic bodies 41 and 42 are provided between the tubular member 31 and the hub 23. Further, as shown in FIG. 2, the spherical elastic bodies 41 and 42 are arranged on an outer peripheral side of a front side portion of the tubular member 31. Further, as shown in FIG. 3 or 4, in the present embodiment, six spherical elastic bodies 41 and 42 are arranged at equal intervals (intervals of 60 degrees) over an entire periphery of the tubular member 31.

The plurality of spherical elastic bodies 41 and 42 include two types of spherical elastic bodies having different hardnesses, that is, the low-hardness spherical elastic bodies 41 and the high-hardness spherical elastic bodies 42. Specifically, a first predetermined hardness is set for the low-hardness spherical elastic body 41, and a second predetermined hardness higher than the first hardness is set for the high-hardness spherical elastic body 42. The low-hardness spherical elastic body 41 is formed of, for example, low-repulsion rubber. The high-hardness spherical elastic body 42 is formed of, for example, high-repulsion rubber or plastic. Further, a diameter D1 of the low-hardness spherical elastic body 41 is larger than a diameter D2 of the high-hardness spherical elastic body 42 (see FIGS. 6A and 6B). In the present embodiment, the six spherical elastic bodies 41 and 42 include the three low-hardness spherical elastic bodies 41 and the three high-hardness spherical elastic bodies 42. Further, in the present embodiment, as shown in FIG. 4, the low-hardness spherical elastic bodies 41 and the high-hardness spherical elastic bodies 42 are alternately arranged one by one in the circumferential direction of the tubular member 31. The spherical elastic bodies 41 and 42 are specific examples of "elastic bodies", the low-hardness spherical elastic body 41 is a specific example of a "first elastic body", and the high-hardness spherical elastic body 42 is a specific example of a "second elastic body".

Each of the spherical elastic bodies 41 and 42 is disposed between a spherical-crown-shaped concave portion 34 formed in the tubular member 31 and a round-bottom groove portion 27 formed in the hub 23. That is, as shown in FIG. 5A, the spherical-crown-shaped concave portions 34, the number of which is the same as the number of the spherical elastic bodies 41 and 42, are formed in the outer peripheral surface of the front side portion of the tubular member 31 so as to be arranged in the circumferential direction. In the present embodiment, six spherical-crown-shaped concave portions 34 are formed, and the spherical-crown-shaped concave portions 34 are arranged at equal intervals (intervals of 60 degrees) over the entire periphery of the tubular member 31. In contrast, as shown in FIGS. 2 to 4, the round-bottom groove portions 27, the number of which is the same as the number of the spherical elastic bodies 41 and 42, are formed in the inner peripheral surface of the front side portion of the insertion hole 24 so as to be arranged in the circumferential direction. In the present embodiment, the six round-bottom groove portions 27 are formed, and the round-bottom groove portions 27 are arranged at equal intervals (intervals of 60 degrees) over the entire periphery of the insertion hole 24. Further, as shown in FIG. 4, each spherical-crown-shaped concave portion 34 opens outward in a radial direction of the tubular member 31, each round-bottom groove portion 27 opens inward in a radial direction of the hub 23, and the six spherical-crown-shaped concave portions 34 and the six round-bottom groove portions 27 face each other. Then, in each of the spherical elastic bodies 41 and 42, a portion (first portion) facing radially inner side of the tubular member 31 is positioned in the spherical-crown-shaped concave portion 34, and a portion (second portion) facing radially outer side of the tubular member 31 is positioned in the round-bottom groove portion 27. The spherical-crown-shaped concave portion 34 is a specific example of a "first concave portion" of a first concave portion group, and the round-bottom groove portion 27 is a specific example of a "second concave portion" of a second concave portion group.

Figure 6A:
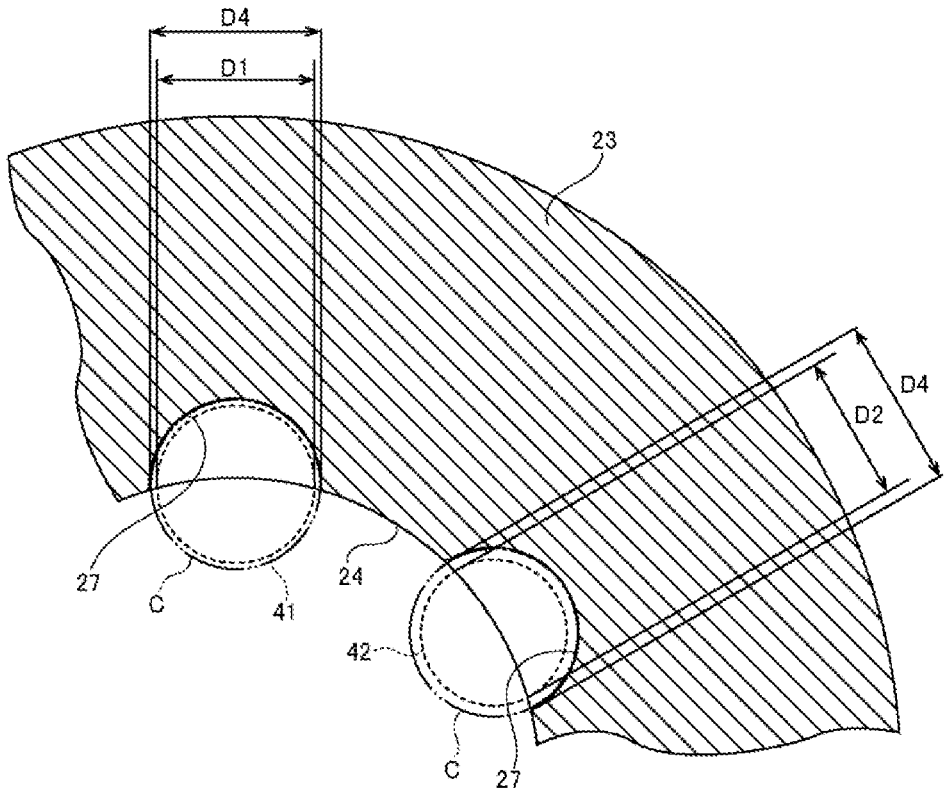
FIGS. 6A and 6B are illustrative diagrams showing sizes of a spherical-crown-shaped concave portion and a round-bottom groove portion of the propeller apparatus of the first embodiment of the present invention.
Figure 6B:
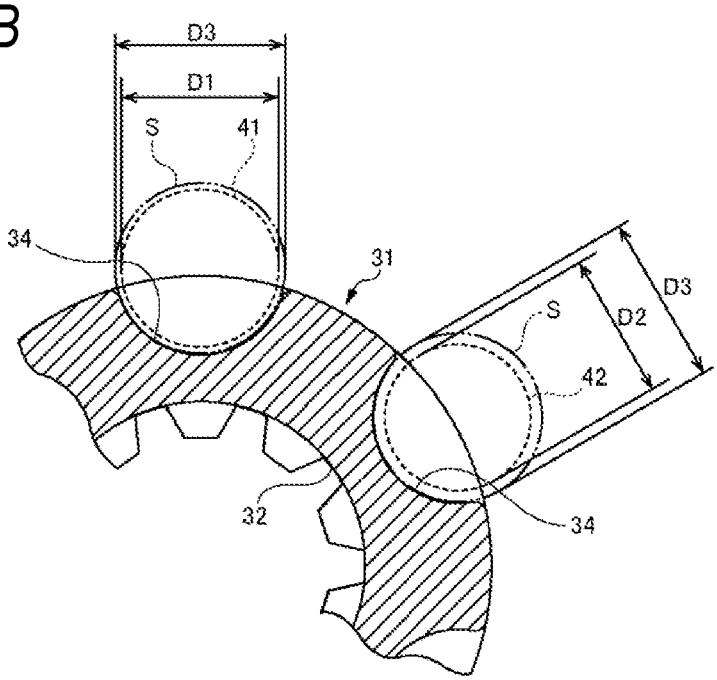

FIG. 6A is an enlarged view of a part of a cross section of the hub 23 shown in FIG. 4. FIG. 6B is an enlarged view of a part of a cross section of the tubular member 31 shown in FIG. 4. As shown in FIG. 6B, in the tubular member 31, each spherical-crown-shaped concave portion 34 is formed in a spherical crown shape that is a part of a sphere S having a diameter D3 larger than both the diameter D1 of the low-hardness spherical elastic body 41 and the diameter D2 of the high-hardness spherical elastic body 42. Further, as shown in FIG. 6A, in the hub 23, each round-bottom groove portion 27 is formed such that a shape of a transverse cross section thereof is an arc shape that is a part of a circle C having a diameter D4 larger than both the diameter D1 of the low-hardness spherical elastic body 41 and the diameter D2 of the high-hardness spherical elastic body 42. Further, in the present embodiment, the diameter D3 of the sphere S corresponding to the spherical crown shape of each spherical-crown-shaped concave portion 34 and the diameter D4 of the circle C corresponding to the arc shape of the transverse cross section of each round-bottom groove portion 27 are equal to each other.

Since the diameters D1 and D2 of the spherical elastic bodies 41 and 42, the diameter D3 of the sphere S corresponding to the spherical crown shape of each spherical-crown-shaped concave portion 34, and the diameter D4 of the circle C corresponding to the arc shape of the transverse cross section of each round-bottom groove portion 27 are set in this way, each of the spherical elastic bodies 41 and 42 is held in a state of having backlash between the spherical-crown-shaped concave portion 34 and the round-bottom groove portion 27 facing each other. Therefore, as will be described later, each of the spherical elastic bodies 41 and 42 can rotate (rotate around a center in the spherical elastic body) between the spherical-crown-shaped concave portion 34 and the round-bottom groove portion 27 facing each other.

As shown in FIG. 2, in the hub 23, each round-bottom groove portion 27 extends in a direction parallel to the axis of the propeller shaft 9. Further, a front end of each round-bottom groove portion 27 reaches a front end of the insertion hole 24, that is, the step portion 26 between the large-diameter hole 25 and the insertion hole 24. Accordingly, as shown in FIG. 3, the front end of each round-bottom groove portion 27 communicates with an inside of the large-diameter hole 25, and opens toward a front side of the hub 23. Further, a rear end of each round-bottom groove portion 27 has a shape of a quarter sphere (a sphere divided into four equal parts by two planes including a center thereof).

The plurality of annular elastic bodies 43 have a function of absorbing the impact between the propeller shaft 9 and the propeller 22. For example, each annular elastic body 43 is made of an elastic material such as rubber, and is formed in an annular shape having a circular or elliptical transverse cross section. Each annular elastic body 43 is, for example, an O-ring. Each annular elastic body 43 is provided between the tubular member 31 and the hub 23. Further, as shown in FIG. 2, the annular elastic bodies 43 are arranged on an outer peripheral side of a portion of the tubular member 31 from a substantially central portion to a rear portion in an axial direction. In the present embodiment, three annular elastic bodies 43 are arranged on the tubular member 31 at predetermined intervals in the axial direction. The annular elastic body 43 is a specific example of a "buffer member".

As shown in FIG. 5A, annular grooves 35, the number of which is the same as the number of the annular elastic bodies 43, are formed on the outer peripheral side of the portion of the tubular member 31 from the substantially central portion to the rear portion in the axial direction. As shown in FIG. 5B, each annular elastic body 43 is mounted on the annular groove 35. As shown in FIG. 2, an inner peripheral side portion of each annular elastic body 43 is positioned in the annular groove 35, and an inner peripheral side surface of each annular elastic body 43 is in contact with a bottom surface of the annular groove 35. Further, an outer peripheral side portion of each annular elastic body 43 protrudes from the annular groove 35 and rises outward in the radial direction of the tubular member 31, and an outer peripheral side surface of each annular elastic body 43 is in contact with an inner peripheral surface of the insertion hole 24. Further, each annular elastic body 43 is provided between the bottom surface of the annular groove 35 and the inner peripheral surface of the insertion hole 24 in a state of being pressed and elastically deformed by the bottom surface of the annular groove 35 and the inner peripheral surface of the insertion hole 24.

(Function of Propeller Apparatus)

The propeller apparatus 21 has, in addition to the function of propelling the ship by the rotation of the propeller 22, an impact absorbing function by the spherical elastic bodies, a gear mechanism protection function by the spherical elastic bodies, a function of preventing deterioration and damage of the spherical elastic bodies, an impact absorbing function by the annular elastic bodies, and a preliminary power transmission function by the annular elastic bodies. Hereinafter, these functions will be described.

[Impact Absorbing Function by Spherical Elastic Bodies]

First, the impact absorbing function by the spherical elastic bodies will be described. In FIG. 4, when the power of the power source 4 is transmitted to the propeller shaft 9 via the drive shaft 6 and the gear mechanism 8 and the propeller shaft 9 and the tubular member 31 start to rotate in a counterclockwise direction (a direction of an arrow F in FIG. 4) at the start of forward movement of the ship, first, a portion at a position P1 of each low-hardness spherical elastic body 41 is pressed by the spherical-crown-shaped concave portion 34, and subsequently, a portion at a position P2 of each low-hardness spherical elastic body 41 presses the round-bottom groove portion 27. At this time, each low-hardness spherical elastic body 41 is pressed and compressed by being sandwiched between the spherical-crown-shaped concave portion 34 and the round-bottom groove portion 27. Accordingly, the impact between the propeller shaft 9 (tubular member 31) and the propeller 22 is absorbed by the low-hardness spherical elastic bodies 41. When each low-hardness spherical elastic body 41 is compressed to some extent in this way, a portion at a position P3 of each high-hardness spherical elastic body 42 is pressed by the spherical-crown-shaped concave portion 34, and subsequently, a portion at a position P4 of each high-hardness spherical elastic body 42 presses the round-bottom groove portion 27. At this time, each high-hardness spherical elastic body 42 is pressed and compressed by being sandwiched between the spherical-crown-shaped concave portion 34 and the round-bottom groove portion 27. However, since each spherical elastic body 42 has a higher hardness than each spherical elastic body 41, a degree of compression of each spherical elastic body 42 is often smaller than a degree of compression of each spherical elastic body 41. However, the impact between the propeller shaft 9 and the propeller 22 is also absorbed by compression of the spherical elastic bodies 42. Thereafter, while the propeller shaft 9 and the tubular member 31 are rotated in the counterclockwise direction, the rotation of the propeller shaft 9 and the tubular member 31 is transmitted to the propeller 22 by the spherical elastic bodies 41 and 42.

In FIG. 4, when the propeller shaft 9 and the tubular member 31 start to rotate in the clockwise direction (the direction of an arrow R in FIG. 4) at the start of backward movement of the ship, first, a portion at a position Q1 of each low-hardness spherical elastic body 41 is pressed by the spherical-crown-shaped concave portion 34, and subsequently, a portion at a position Q2 of each low-hardness spherical elastic body 41 presses the round-bottom groove portion 27. At this time, each low-hardness spherical elastic body 41 is sandwiched and compressed between the spherical-crown-shaped concave portion 34 and the round-bottom groove portion 27. Accordingly, the impact between the propeller shaft 9 and the propeller 22 is absorbed by the low-hardness spherical elastic bodies 41. Subsequently, a portion at a position Q3 of each high-hardness spherical elastic body 42 is pressed by the spherical-crown-shaped concave portion 34, and subsequently, a portion at a position Q4 of each high-hardness spherical elastic body 42 presses the round-bottom groove portion 27. At this time, each high-hardness spherical elastic body 42 is sandwiched and compressed between the spherical-crown-shaped concave portion 34 and the round-bottom groove portion 27. Accordingly, the impact between the propeller shaft 9 and the propeller 22 is absorbed by the high-hardness spherical elastic bodies 42. Thereafter, while the propeller shaft 9 and the tubular member 31 are rotated in the clockwise direction, the rotation of the propeller shaft 9 and the tubular member 31 is transmitted to the propeller 22 by the spherical elastic bodies 41 and 42.

In this way, when a torque of rotation of the propeller shaft 9 fluctuates at the start of forward movement or backward movement of the ship, at the time of reversing a traveling direction of the ship, at the time of rapid acceleration or at the time of rapid deceleration of the ship, or the like, the impact between the propeller shaft 9 (tubular member 31) and the propeller 22 is absorbed in two stages by the spherical elastic bodies 41 and 42. Accordingly, it is possible to effectively reduce the impact between the propeller shaft 9 and the propeller 22 caused by the torque fluctuation or the like.

[Gear Mechanism Protection Function by Spherical Elastic Bodies]

Next, the gear mechanism protection function by the spherical elastic bodies will be described. A hardness of each of the spherical elastic bodies 41 and 42 (particularly, a hardness of the high-hardness spherical elastic body 42) is set such that the rotation of the propeller shaft 9 and the tubular member 31 can be reliably transmitted to the propeller 22 when a magnitude of a load applied to the propeller 22 is within a normal range. Further, the hardness of each of the spherical elastic bodies 41 and 42 is set such that when the load applied to the propeller 22 becomes excessive and the magnitude of the load fairly exceeds the normal range described above, the spherical elastic bodies 41 and 42 are intentionally damaged by the excessive load and transmission of the excessive load from the propeller 22 to the propeller shaft 9 is cut off. When the propeller shaft 9 and the tubular member 31 are rotated by the power of the power source 4, for example, if the propeller 22 is in contact with a reef, a bottom of water, or the like and an excessive load is applied to the propeller 22, the spherical elastic bodies 41 and 42 are damaged, so that the excessive load is not transmitted to the propeller shaft 9. Accordingly, it is possible to prevent the excessive load from being transmitted to the gear mechanism 8 and the like via the propeller shaft 9 and damage to the gear mechanism 8 and the like.

[Function of Preventing Deterioration and Damage of Spherical Elastic Bodies]

Next, the function of preventing the deterioration and the damage of the spherical elastic bodies will be described. As described above, each of the spherical elastic bodies 41 and 42 is held in a state of having backlash between the spherical-crown-shaped concave portion 34 and the round-bottom groove portion 27 facing each other. Therefore, each of the spherical elastic bodies 41 and 42 can rotate between the spherical-crown-shaped concave portion 34 and the round-bottom groove portion 27 facing each other. For example, when the propeller shaft 9 and the tubular member 31 are stopped, the spherical elastic bodies 41 and 42 may rotate by receiving a water flow around the propeller apparatus 21. Further, when a rotational speed of the propeller shaft 9 or a load applied to the propeller 22 suddenly changes and a torque between the tubular member 33 and the hub 23 suddenly changes, the spherical elastic bodies 41 and 42 may be pushed by any one of the spherical-crown-shaped concave portions 34 and the round-bottom groove portions 27 and rotate. The rotation of the spherical elastic bodies 41 and 42 changes directions of the spherical elastic bodies 41 and 42. When the directions of the spherical elastic bodies 41 and 42 are changed, the portions of the spherical elastic bodies 41 and 42 that are pressed by the spherical-crown-shaped concave portions 34 and the portions of the spherical elastic bodies 41 and 42 that press the round-bottom groove portions 27 are changed during the rotation of the propeller shaft 9 and the tubular member 31. That is, when the directions of the spherical elastic bodies 41 and 42 are changed, portions of the spherical elastic bodies 41 and 42 where stress is generated are changed during the rotation of the propeller shaft 9 and the tubular member 31. Therefore, repeated stress concentration on the same place in the spherical elastic bodies 41 and 42 is prevented. Accordingly, it is possible to prevent early deterioration or damage of the spherical elastic bodies 41 and 42 due to repeated stress concentration on the same place of the spherical elastic bodies 41 and 42.

[Impact Absorbing Function by Annular Elastic Bodies]

Next, the impact absorbing function by the annular elastic bodies will be described. The annular elastic bodies 43 are provided on the outer peripheral side of the portion of the tubular member 31 from the substantially central portion to the rear portion in the axial direction. In FIG. 1, for example, when front side portions of tip end portions of the blades 28 of the propeller 22 hit the bottom of the water during the forward movement of the ship and an impact in a direction intersecting the axis of the propeller shaft 9 is applied to the propeller 22 as indicated by an arrow A in the drawing, the annular elastic bodies 43 are elastically deformed by receiving the impact. Because of the elastic deformation of the annular elastic bodies 43, the propeller 22 can be displaced to some extent with respect to the propeller shaft 9 in a direction in which an axis of the propeller 22 is inclined or misaligned with respect to the axis of the propeller shaft 9. Accordingly, an impact applied to the propeller 22 in a direction intersecting the axis of the propeller shaft 9 can be reduced.

[Preliminary Power Transmission Function by Annular Elastic Bodies]

Next, the preliminary power transmission function by the annular elastic bodies will be described. Each annular elastic body 43 is provided between the bottom surface of the annular groove 35 and the inner peripheral surface of the insertion hole 24 in a state of being elastically deformed by being pressed by the bottom surface of the annular groove 35 and the inner peripheral surface of the insertion hole 24. Therefore, when the propeller shaft 9 and the tubular member 31 are rotated, the propeller 22 is rotated because of friction between the annular elastic bodies 43 and the inner peripheral surface of the insertion hole 24. In this way, each annular elastic body 43 has a capability of transmitting the rotation of the propeller shaft 9 and the tubular member 31 to the propeller 22. As described above, when an excessive load is applied to the propeller 22 and the spherical elastic bodies 41 and 42 are damaged, it is difficult to transmit the rotation of the propeller shaft 9 and the tubular member 31 to the propeller 22 via the spherical elastic bodies 41 and 42. Even when such a situation occurs, when rotational speeds of the propeller shaft 9 and the tubular member 31 are low and a magnitude of a load applied between the tubular member 31 and the propeller 22 is smaller than a frictional force between the annular elastic bodies 43 and the inner peripheral surface of the insertion hole 24, the rotation of the propeller shaft 9 and the tubular member 31 can be transmitted to the propeller 22 via the annular elastic bodies 43. Therefore, even when the spherical elastic bodies 41 and 42 are damaged, the ship can be moved and docked at a low speed thereafter.

As described above, the propeller apparatus 21 of the first embodiment of the present invention includes the spherical elastic bodies 41 and 42 having a spherical shape as members having a function of absorbing the impact between the propeller shaft 9 and the propeller 22 and transmitting the rotation of the propeller shaft 9 to the propeller 22. Further, each of the spherical elastic bodies 41 and 42 is held in a state of having backlash between the spherical-crown-shaped concave portion 34 and the round-bottom groove portion 27, and each of the spherical elastic bodies 41 and 42 can rotate between the spherical-crown-shaped concave portion 34 and the round-bottom groove portion 27. With this configuration, as described above, the spherical elastic bodies 41 and 42 can change their directions when the spherical elastic bodies 41 and 42 receive the water flow around the propeller apparatus 21 or when the torque between the tubular member 33 and the hub 23 suddenly changes. Since the directions of the spherical elastic bodies 41 and 42 can be changed in this way, the repeated stress concentration on the same place in the spherical elastic bodies 41 and 42 can be prevented, and the early deterioration or damage of the spherical elastic bodies 41 and 42 due to the repeated stress concentration can be prevented.

In the propeller apparatus 21 of the first embodiment of the present invention, since the spherical elastic bodies 41 and 42 have a simple spherical shape and rotate, salt, sand, dust, and the like are unlikely to adhere to the spherical elastic bodies 41 and 42. Further, since the spherical-crown-shaped concave portion 34 that holds each of the spherical elastic bodies 41 and 42 has the spherical crown shape, the transverse cross-sectional shape of the round-bottom groove portion 27 has the arc shape, and each of the spherical elastic bodies 41 and 42 is held in the state of having the backlash between the spherical-crown-shaped concave portion 34 and the round-bottom groove portion 27, water around the propeller apparatus 21 easily and smoothly flows between each of the spherical elastic bodies 41 and 42 and each spherical-crown-shaped concave portion 34 and between each of the spherical elastic bodies 41 and 42 and each round-bottom groove portion 27. Therefore, salt, sand, dust, and the like that have entered between each of the spherical elastic bodies 41 and 42 and each spherical-crown-shaped concave portion 34 or between each of the spherical elastic bodies 41 and 42 and each round-bottom groove portion 27 are discharged to an outside of the propeller apparatus 21 by a water flow. As a result, the salt, the sand, the dust, and the like are unlikely to accumulate around the spherical elastic bodies 41 and 42 (in the spherical-crown-shaped concave portions 34, in the round-bottom groove portions 27, or the like). Therefore, it is possible to prevent that elastic deformation of the spherical elastic bodies 41 and 42 is hindered and the impact absorbing function of the spherical elastic bodies 41 and 42 deteriorates due to the salt, the sand, the dust, and the like adhering to the spherical elastic bodies 41 and 42 or the salt, the sand, the dust, and the like accumulating around the spherical elastic bodies 41 and 42.

In the propeller apparatus 21 of the first embodiment of the present invention, the spherical elastic bodies 41 and 42 have the spherical shape and have a simple shape. Therefore, the spherical elastic bodies 41 and 42 are easy to manufacture and inexpensive. Commercially available rubber balls can also be used as the spherical elastic bodies 41 and 42. Further, each annular elastic body 43 also has a simple shape and is inexpensive. Therefore, when replacing the deteriorated or damaged spherical elastic body 41 or 42 or the annular elastic body 43 with a new one, an economic burden on a user is small. In this way, according to the propeller apparatus 21 of the first embodiment of the present invention, it is possible to reduce the economic burden on the user when performing maintenance of the propeller apparatus 21.

Since the spherical elastic bodies 41 and 42 are easy to manufacture and inexpensive, various spherical elastic bodies having different sizes or hardnesses can be easily manufactured or procured. Therefore, it is possible to easily select a spherical elastic body having an optimum size or hardness in accordance with a size, a propeller pitch, or the like of the propeller 22 attached to the outboard motor 1.

Here, a method of assembling the propeller apparatus 21 and mounting the propeller apparatus 21 on the propeller shaft 9 will be described. In FIG. 2, (1) first, the annular elastic bodies 43 are mounted on the annular grooves 35 of the tubular member 31. Since the annular elastic body 43 is an annular elastic body such as an O-ring, the annular elastic body 43 can be easily mounted on the annular groove 35. (2) Next, the spherical elastic bodies 41 and 42 are placed in the spherical-crown-shaped concave portions 34 of the tubular member 31. At this time, the spherical elastic bodies 41 and 42 are adhered to the spherical-crown-shaped concave portions 34 by using an adhesive or the like such that the spherical elastic bodies 41 and 42 do not fall off from the spherical-crown-shaped concave portions 34 during the assembly work. When the outboard motor is used, each of the spherical elastic bodies 41 and 42 needs to be rotatable between the spherical-crown-shaped concave portion 34 and the round-bottom groove portion 27, and therefore, for example, an adhesive having a fairly weak adhesive force, an adhesive having a property of being dissolved in water and losing the adhesive force, or the like is used as the adhesive for adhering the spherical elastic bodies 41 and 42 to the spherical-crown-shaped concave portions 34 during the assembly. (3) Next, the tubular member 31 on which the annular elastic bodies 43 are mounted and the spherical elastic bodies 41 and 42 are placed is inserted into the insertion hole 24 of the hub 23 of the propeller 22 from the front side of the hub 23, so that the tubular member 31, the spherical elastic bodies 41 and 42, and the annular elastic bodies 43 are attached to the propeller 22. (4) Next, the front side spacer 12 is mounted on the rear end portion of the propeller shaft 9. (5) Next, the propeller 22 to which the tubular member 31 and the like are attached is mounted on the rear end portion of the propeller shaft 9. (6) Next, the rear side spacer 13 is mounted on the rear end portion of the propeller shaft 9. (7) Next, the nut 14 is fastened to the rear end portion of the propeller shaft 9.

According to the propeller apparatus 21 of the first embodiment of the present invention, the propeller apparatus 21 can be easily assembled. That is, among propeller apparatus in the related art, there is a propeller apparatus in which, when a damper member having a function of absorbing an impact between a propeller shaft and a propeller is mounted on the propeller apparatus, the damper member needs to be press-fitted into the propeller apparatus, and in this press-fitting step, a special press-fitting tool needs to be used, or the damper member needs to be heated. On the contrary, in the propeller apparatus 21 of the first embodiment of the present invention, the propeller apparatus 21 can be assembled by mounting the annular elastic bodies 43 that can be easily mounted on the annular grooves 35 of the tubular member 31, placing the spherical elastic bodies 41 and 42 in the spherical-crown-shaped concave portions 34 of the tubular member 31, and then inserting the tubular member 31 into the insertion hole 24 of the hub 23. When the annular elastic bodies 43 are mounted on the tubular member 31, the spherical elastic bodies 41 and 42 are placed on the tubular member 31, and the tubular member 31 is inserted into the insertion hole 24, the special press-fitting tool is not necessary, and it is also not necessary to heat the annular elastic bodies 43 or the spherical elastic bodies 41 and 42. In this way, according to the propeller apparatus 21 of the first embodiment of the present invention, the propeller apparatus 21 can be assembled more easily than the propeller apparatus in the related art that requires the special press-fitting tool or heating of the damper member for mounting the damper member.

Second Embodiment

Figure 7:
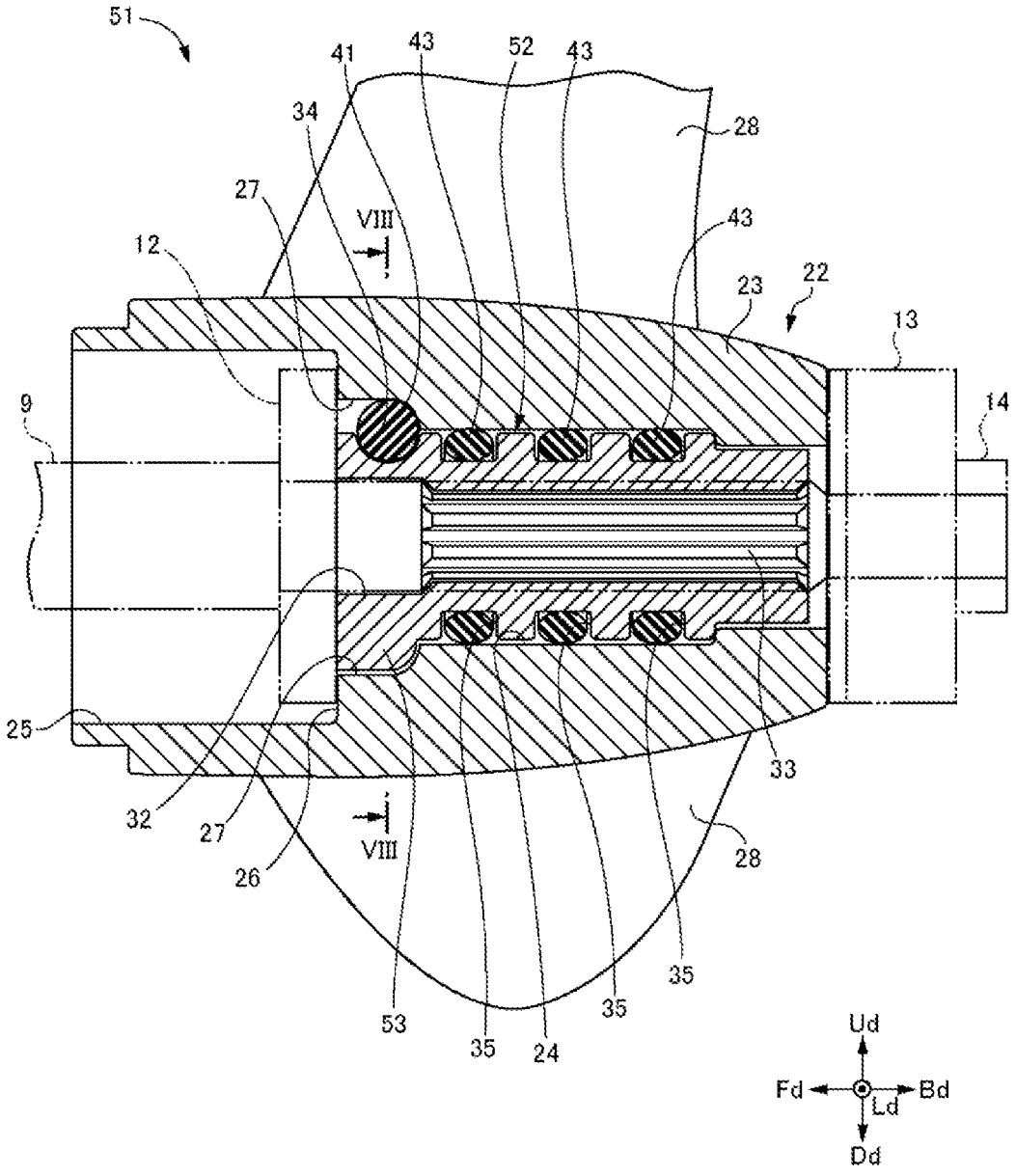
FIG. 7 is a cross-sectional view showing a propeller apparatus of a second embodiment of the present invention.
Figure 8:
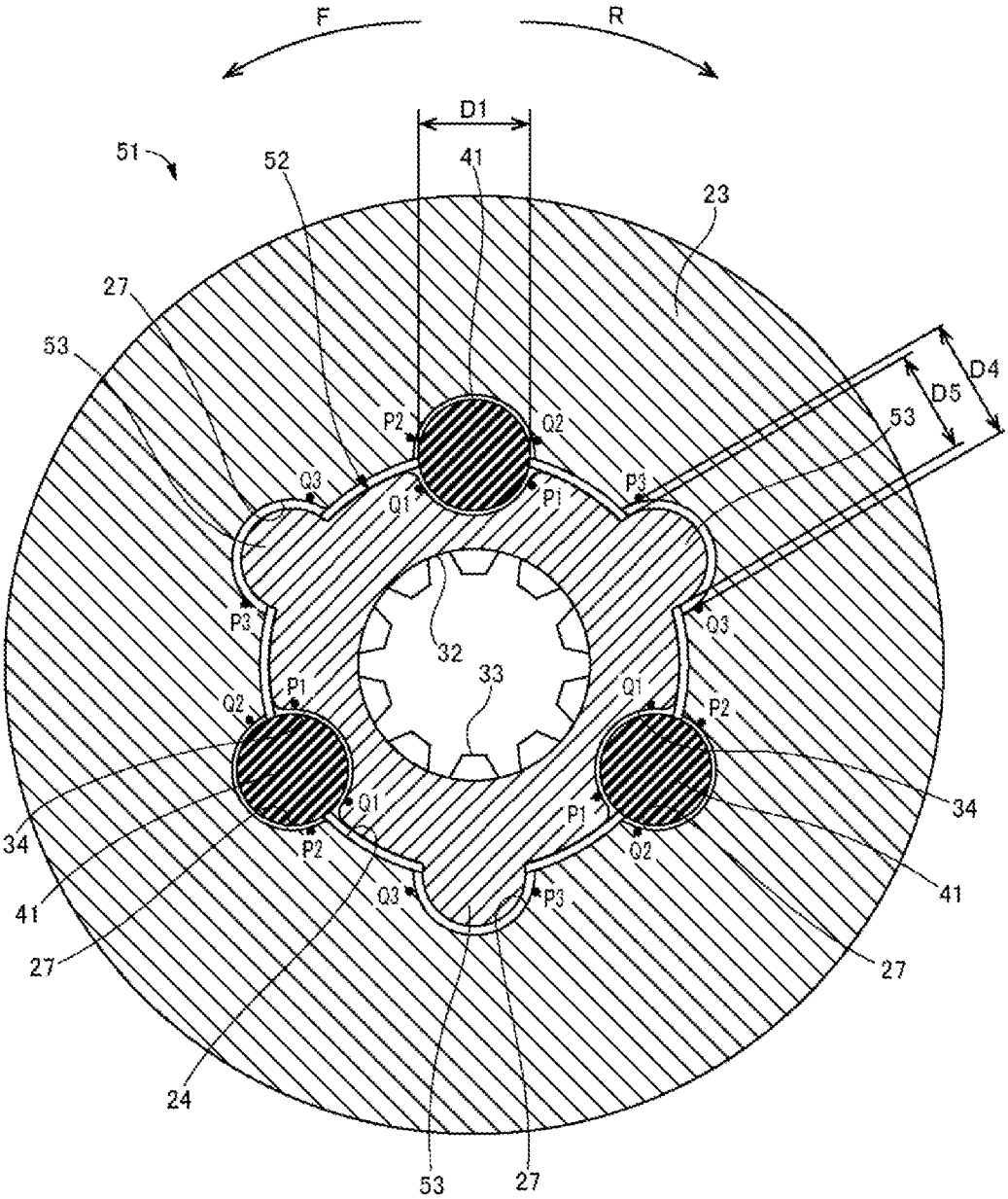
FIG. 8 is a cross-sectional view showing a state where a cross section of the propeller apparatus cut along a cutting line VIII-VIII in FIG. 7 is viewed from a front side.
Figure 9:
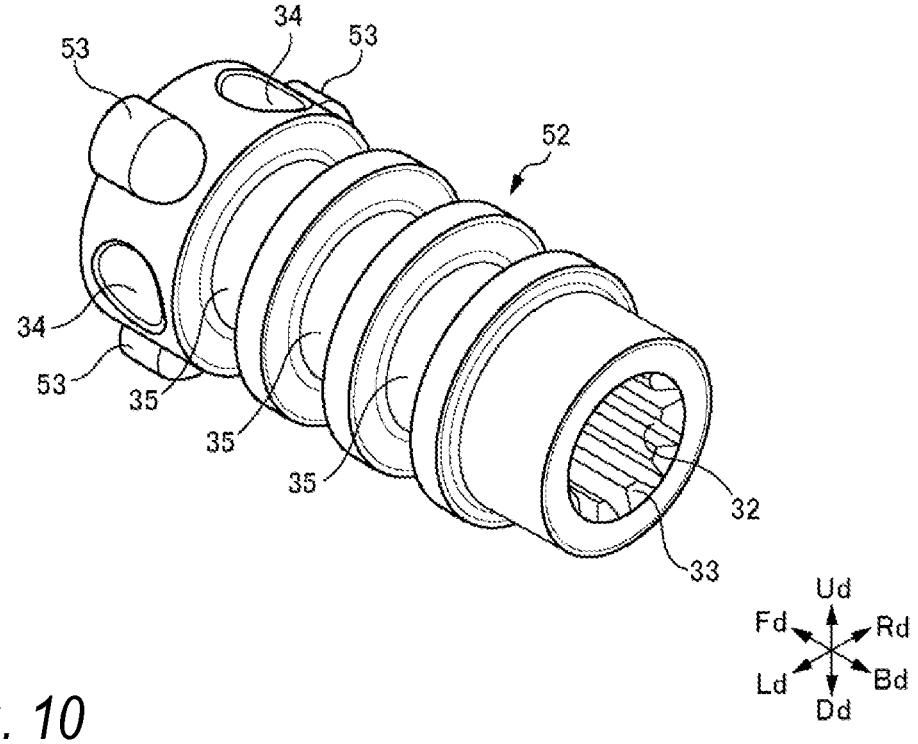
FIG. 9 is an external view showing a state where a tubular member of the propeller apparatus of the second embodiment of the present invention is viewed from an upper left rear side.

FIG. 7 shows a cross section of a propeller apparatus 51 of a second embodiment of the present invention at the same position as that of FIG. 2. FIG. 8 shows a state where the cross section of the propeller apparatus 51 cut along a cutting line VIII-VIII in FIG. 7 is viewed from a front side. In FIG. 8, illustration of the blades 28 is omitted. FIG. 9 shows a state where a tubular member 52 of the second embodiment of the present invention is viewed from an upper left rear side. In the propeller apparatus 51 of the second embodiment, the same components as those of the propeller apparatus 21 of the first embodiment are denoted by the same reference numerals, and description thereof will be simplified or omitted.

As can be seen from a comparison between FIG. 4 and FIG. 8, the propeller apparatus 51 of the second embodiment includes a plurality of round convex portions 53 instead of the plurality of high-hardness spherical elastic bodies 42 and the plurality of spherical-crown-shaped concave portions 34 corresponding to the plurality of high-hardness spherical elastic bodies 42 in the propeller apparatus 21 of the first embodiment.

Each round convex portion 53 has a function of transmitting rotation of the propeller shaft 9 to the propeller 22. As shown in FIG. 9, each round convex portion 53 protrudes radially outward from an outer peripheral surface of a front side portion of the tubular member 52. Each round convex portion 53 has a substantially semicircular transverse cross section and extends in a direction parallel to an axis of the propeller shaft 9. Further, as shown in FIG. 7, a front end of each round convex portion 53 reaches a front end of the tubular member 52. Further, a rear end of each round convex portion 53 has a shape of a quarter sphere (a sphere divided into four equal parts by two planes including a center thereof). Further, each round convex portion 53 in the present embodiment is integrally formed with the tubular member 52 by molding or the like, and is formed of, for example, a metal material such as stainless steel or brass. Each round convex portion 53 may be formed by joining a member formed of a metal material to the tubular member 52 by welding or the like.

In the present embodiment, as shown in FIG. 8, the three round convex portions 53 are arranged at equal intervals (intervals of 120 degrees) over an entire periphery of the tubular member 52. Further, in the present embodiment, the low-hardness spherical elastic bodies 41 and the round convex portions 53 are alternately arranged one by one in a circumferential direction of the tubular member 52.

Tip end side portions of the three round convex portions 53 are positioned in the three round-bottom groove portions 27 arranged at intervals of 120 degrees among the six round-bottom groove portions 27 arranged at intervals of 60 degrees on an inner peripheral surface of a front side portion of the insertion hole 24 of the hub 23. Further, as shown in FIG. 8, each round convex portion 53 is formed such that the shape of the transverse cross section thereof is an arc shape that is a part of a circle having a diameter D5 smaller than the diameter D1 of the low-hardness spherical elastic body 41. Further, the diameter D5 of the circle corresponding to the arc shape of the transverse cross section of each round convex portion 53 is smaller than the diameter D4 of a circle corresponding to an arc shape of a transverse cross section of each round-bottom groove portion 27 of the hub 23. The tip end side portion of each round convex portion 53 is inserted into the round-bottom groove portion 27 in a state of having backlash. The round convex portion 53 is a specific example of a "convex portion", and the spherical-crown-shaped concave portion 34 corresponding to the round convex portion 53 is a specific example of a "third concave portion".

The propeller apparatus 51 of the second embodiment has an impact absorbing function by the spherical elastic bodies, a function of preventing deterioration and damage of the spherical elastic bodies, and an impact absorbing function by the annular elastic bodies, in addition to the function of propelling the ship by rotation of the propeller 22. The function of preventing the deterioration and the damage of the spherical elastic bodies and the impact absorbing function by the annular elastic bodies are the same as those of the propeller apparatus 21 of the first embodiment.

The impact absorbing function by the spherical elastic bodies of the propeller apparatus 51 of the second embodiment will be described. In FIG. 8, when power of the power source 4 is transmitted to the propeller shaft 9 via the drive shaft 6 and the gear mechanism and the propeller shaft 9 and the tubular member 52 start to rotate in a counterclockwise direction (a direction of an arrow F in FIG. 8) at the start of forward movement of the ship, first, a portion at a position P1 of each spherical elastic body 41 is pressed by the spherical-crown-shaped concave portion 34, and subsequently, a portion at a position P2 of each spherical elastic body 41 presses the round-bottom groove portion 27. At this time, each spherical elastic body 41 is pressed and compressed by being sandwiched between the spherical-crown-shaped concave portion 34 and the round-bottom groove portion 27. Accordingly, an impact between the propeller shaft 9 (tubular member 52) and the propeller 22 is absorbed by the spherical elastic bodies 41. When each spherical elastic body 41 is compressed to some extent in this way, a portion at the position P3 of each round convex portion 53 presses the round-bottom groove portion 27. While the propeller shaft 9 and the tubular member 52 are rotated in a counterclockwise direction, rotation of the propeller shaft 9 and the tubular member 52 is transmitted to the propeller 22 by the spherical elastic bodies 41 and the round convex portions 53.

In FIG. 8, when the propeller shaft 9 and the tubular member 52 start to rotate in a clockwise direction (a direction of an arrow R in FIG. 8) at the start of backward movement of the ship, first, a portion at the position Q1 of each spherical elastic body 41 is pressed by the spherical-crown-shaped concave portion 34, and subsequently, a portion at the position Q2 of each spherical elastic body 41 presses the round-bottom groove portion 27. At this time, each spherical elastic body 41 is pressed and compressed by being sandwiched between the spherical-crown-shaped concave portion 34 and the round-bottom groove portion 27. Accordingly, the impact between the propeller shaft 9 (tubular member 52) and the propeller 22 is absorbed by the spherical elastic bodies 41. When each spherical elastic body 41 is compressed to some extent in this way, a portion at a position Q3 of each round convex portion 53 presses the round-bottom groove portion 27. While the propeller shaft 9 and the tubular member 52 are rotated in the clockwise direction, the rotation of the propeller shaft 9 and the tubular member 52 is transmitted to the propeller 22 by the spherical elastic bodies 41 and the round convex portions 53.

In this way, when a torque of rotation of the propeller shaft 9 fluctuates at the start of forward movement or backward movement of the ship, at the time of reversing a traveling direction of the ship, at the time of rapid acceleration or at the time of rapid deceleration of the ship, or the like, the impact between the propeller shaft 9 (tubular member 52) and the propeller 22 is absorbed by the spherical elastic bodies 41. Accordingly, the impact between the propeller shaft 9 and the propeller 22 caused by the torque fluctuation or the like can be reduced.

While the propeller shaft 9 and the tubular member 52 are rotated, the round convex portion 53 formed of the metal material presses the round-bottom groove portion 27, so that the rotation of the propeller shaft 9 and the tubular member 52 is transmitted to the propeller 22. Since each round convex portion 53 has a hardness higher than that of the high-hardness spherical elastic body 42 in the first embodiment, even when the torque of the rotation of the propeller shaft 9 is large, the rotation of the propeller shaft 9 can be reliably transmitted to the propeller 22 via the round convex portions 53. Therefore, the propeller apparatus 51 of the second embodiment can be suitably used for an outboard motor equipped with a high-torque and high-output power source.

In the propeller apparatus 51 of the second embodiment, a direction of each spherical elastic body 41 is changed in substantially the same manner as the propeller apparatus 21 of the first embodiment, so that an effect of preventing repeated stress concentration on the same place of the spherical elastic body 41 and preventing early deterioration and damage of the spherical elastic body 41, an effect of preventing deterioration of the impact absorbing function of the spherical elastic body 41 due to accumulation of salt, sand, dust, and the like around the spherical elastic body 41, an effect of reducing an economic burden on the user when performing maintenance of the propeller apparatus 51, an effect that an optimum spherical elastic body can be easily selected in accordance with a size, a propeller pitch, or the like of the propeller 22 attached to the outboard motor 1, and an effect that the propeller apparatus 51 can be easily assembled are achieved.

Figure 10:
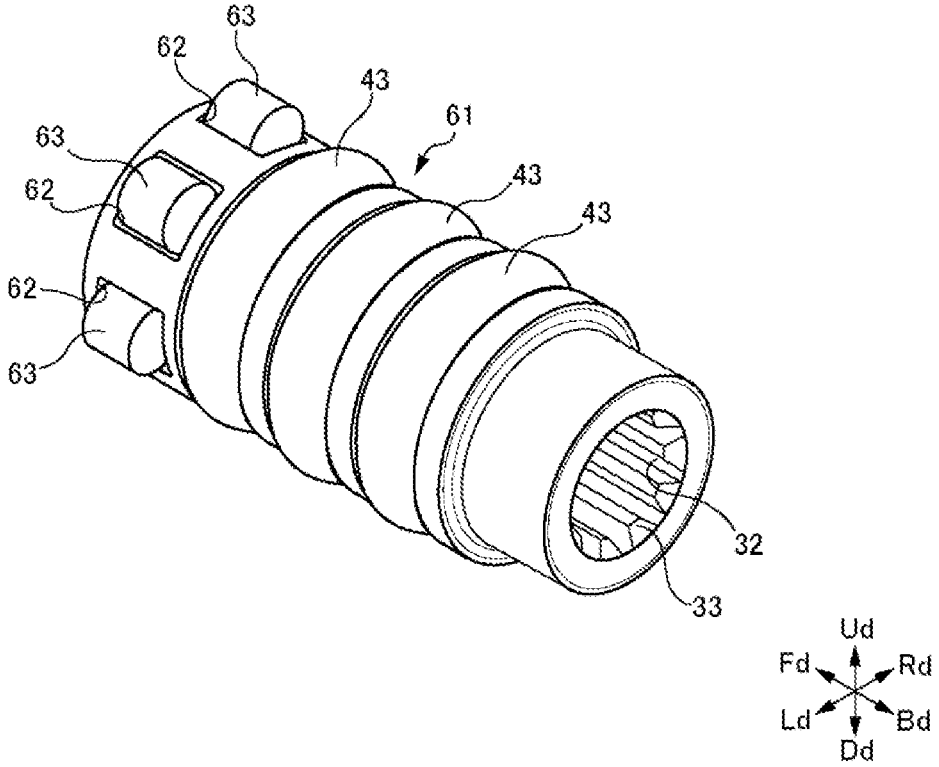
FIG. 10 is an external view showing a state where a tubular member and the like of a propeller apparatus of another embodiment of the present invention are viewed from an upper left rear side.

The spherical elastic bodies 41 and 42 in the first embodiment described above may be substantially spherical from a viewpoint of easy rotation, and may be, for example, a 20-sided body, a 32-sided body, or the like. Further, a shape of the elastic body may be a columnar shape like columnar elastic bodies 63 placed in round-bottom concave portions 62 formed in an outer peripheral surface of a front side portion of a cylindrical member 61 shown in FIG. 10. The columnar elastic body 63 is disposed such that an axis thereof is parallel to an axis of a propeller shaft. Further, in order to make the columnar elastic body 63 easy to rotate, it is preferable to shorten a dimension of the columnar elastic body 63 in an axial direction.

In the first embodiment, the total number of the spherical elastic bodies is not limited to six, and may be three, four, five, or seven or more. Further, in the second embodiment, the number of the round convex portions 53 is not limited to three, and may be one, two, or four or more.

In the first embodiment described above, a ratio of the number of the low-hardness spherical elastic bodies 41 to the number of the high-hardness spherical elastic bodies 42 is 1:1, but the ratio of the number of the low-hardness spherical elastic bodies 41 to the number of the high-hardness spherical elastic bodies 42 is not limited thereto.

In the first embodiment described above, the diameter D1 of the low-hardness spherical elastic body 41 is larger than the diameter D2 of the high-hardness spherical elastic body 42, but diameters of all the spherical elastic bodies may be the same, a diameter of a sphere corresponding to the spherical crown shape of each spherical-crown-shaped concave portion 34 corresponding to the low-hardness spherical elastic body 41 may be smaller than a diameter of a sphere corresponding to the spherical crown shape of each spherical-crown-shaped concave portion 34 corresponding to the high-hardness spherical elastic body 41, and a diameter of a circle corresponding to the arc shape of the transverse cross section of each round-bottom groove portion 27 corresponding to the low-hardness spherical elastic body 41 may be smaller than a diameter of a circle corresponding to the arc shape of the transverse cross section of each round-bottom groove portion 27 corresponding to the high-hardness spherical elastic body 41.

In the first embodiment described above, all the spherical elastic bodies may have the same hardness. Further, three or more types of spherical elastic bodies having different hardnesses may be provided.

In the above-described embodiments, a case where the spherical-crown-shaped concave portions 34 are formed in the tubular member 31 (52) and the round-bottom groove portions 27 are formed in the hub 23 has been described as an example, but the round-bottom groove portions 27 may be formed in the tubular member 31 (52), and the spherical-crown-shaped concave portions 34 may be formed in the hub 23.

The propeller apparatus of the present invention is not limited to the outboard motor, and can also be applied to other types of ship propulsion machines such as an inboard motor and an inboard and outboard motor.

The present invention can be appropriately changed without departing from the gist or idea of the invention that can be read from the claims and the entire specification, and a propeller apparatus with such a change is also included in the technical idea of the present invention.

What is claimed:

1. A propeller apparatus of a ship propulsion machine, the propeller apparatus comprising:

a propeller including a hub having an insertion hole formed in a center thereof and a plurality of blades provided on the hub;

a tubular member inserted into the insertion hole and configured such that a propeller shaft is inserted into an inner side of the tubular member and the tubular member is non-rotatably coupled to the propeller shaft; and a plurality of elastic bodies provided between the tubular member and the hub, and configured to absorb an impact between the propeller shaft and the propeller, and to transmit a rotation of the propeller shaft to the propeller, wherein the tubular member is inserted into the insertion hole in a state of having a backlash so as to be movable in a circumferential direction with respect to the hub, a first concave portion group including a plurality of first concave portions which are arranged in a circumferential direction is formed in an outer peripheral surface of the tubular member, a second concave portion group including a plurality of second concave portions which are arranged in the circumferential direction so as to respectively face the plurality of first concave portions is formed in an inner peripheral surface of the insertion hole, and each of the elastic bodies has a spherical shape or a columnar shape, a first portion of each of the elastic bodies is disposed in each of the first concave portions, a second portion of each of the elastic bodies is disposed in each of the second concave portions, and the elastic bodies are rotatably held in a state of having backlash between the first concave portions and the second concave portions facing each other.

2. The propeller apparatus according to claim 1, wherein each of the elastic bodies has the spherical shape, each concave portion of one of the first concave portion group and the second concave portion group is formed in a spherical crown shape that is a part of a sphere having a diameter larger than a diameter of the elastic bodies disposed in the each concave portion, and each concave portion of the other one of the first concave portion group and the second concave portion group is a groove that extends in a direction parallel to an axis of the propeller shaft and a shape of a transverse cross section is formed in an arc shape that is a part of a circle having a diameter larger than a diameter of the elastic bodies disposed in the each concave portion.

3. The propeller apparatus according to claim 1, wherein the plurality of elastic bodies include a first elastic body having a first hardness and a second elastic body having a second hardness higher than the first hardness.

4. The propeller apparatus according to claim 1, wherein a convex portion that protrudes outward in a radial direction is provided on the outer peripheral surface of the tubular member, a third concave portion is provided in the inner peripheral surface of the insertion hole so as to correspond to the convex portion, and a tip end side portion of the convex portion is positioned in the third concave portion.

5. The propeller apparatus according to claim 1, further comprising:

a buffer member formed of an elastic material, having an annular shape, and disposed between the tubular member and the hub, wherein the plurality of elastic bodies are arranged on an outer peripheral side of one side portion of the tubular member in an axial direction of the tubular member, and the buffer member is disposed on an outer peripheral side of another side portion of the tubular member opposite to the one side portion in the axial direction.

* * * * *